US008138106B2

(12) United States Patent
Hamed et al.

(10) Patent No.: US 8,138,106 B2
(45) Date of Patent: Mar. 20, 2012

(54) CELLULOSIC FIBERS WITH ODOR CONTROL CHARACTERISTICS

(75) Inventors: Othman A. Hamed, Jesup, GA (US); Harry J. Chmielewski, Brunswick, GA (US)

(73) Assignee: Rayonier TRS Holdings Inc., Jacksonville, FL (US)

( * ) Notice: Subject to any disclaimer, the term of this patent is extended or adjusted under 35 U.S.C. 154(b) by 0 days.

(21) Appl. No.: 11/239,278

(22) Filed: Sep. 30, 2005

(65) Prior Publication Data

US 2007/0077428 A1 Apr. 5, 2007

(51) Int. Cl.
*B32B 27/04* (2006.01)
*B32B 5/02* (2006.01)
*B32B 9/04* (2006.01)

(52) U.S. Cl. ..... 442/123; 422/152; 422/153

(58) Field of Classification Search ..... 442/123, 442/152, 153

See application file for complete search history.

(56) References Cited

U.S. PATENT DOCUMENTS

| | | | |
|---|---|---|---|
| 786,004 | A | 3/1905 | Cohn |
| 1,144,291 | A | 6/1915 | Boyer |
| 1,950,286 | A | 3/1934 | Barkow |
| 1,950,957 | A | 3/1934 | Wilhelm |
| 1,953,526 | A | 4/1934 | Ainslie et al. |
| 2,047,975 | A | 7/1936 | Liberthson |
| 2,066,946 | A | 1/1937 | Reiman |
| 2,250,480 | A | 7/1941 | Gump |
| 2,334,572 | A | 11/1943 | Melton et al. |
| 2,349,152 | A | 5/1944 | Feinstone |
| 2,436,673 | A | 2/1948 | Shelton |
| 2,467,884 | A | 4/1949 | Elias |
| 2,474,306 | A | 6/1949 | Doub |
| 2,666,369 | A | 1/1954 | Niks |
| 2,693,438 | A | 11/1954 | Ward |
| 2,813,056 | A | 11/1957 | Davis et al. |
| 2,837,462 | A | 6/1958 | Van Norden Morin |
| 2,833,283 | A | 5/1959 | Spahr et al. |
| 2,833,669 | A | 5/1959 | Ziegler |
| 3,004,895 | A | 10/1961 | Schwartz |
| 3,067,745 | A | 12/1962 | Burgeni et al. |
| 3,093,546 | A | 6/1963 | Atkinson |
| 3,124,135 | A | 3/1964 | Olson |
| 3,329,145 | A | 7/1967 | De Merre |
| 3,491,759 | A | 1/1970 | Samuel |
| 3,560,332 | A | 2/1971 | Crandall et al. |
| 3,707,148 | A | 12/1972 | Bryce |
| 3,765,371 | A | 10/1973 | Fisher |
| 3,794,034 | A | 2/1974 | Jones, Sr. |
| 3,903,259 | A | 9/1975 | Hart |
| 3,939,838 | A | 2/1976 | Fujinami et al. |
| 3,964,486 | A | 6/1976 | Blaney |
| 4,010,252 | A | 3/1977 | Hewitt |
| 4,059,114 | A | 11/1977 | Richards |
| 4,174,418 | A | 11/1979 | Welch et al. |
| 4,199,322 | A | 4/1980 | Danna et al. |
| 4,222,819 | A | 9/1980 | Fossum et al. |
| 4,227,882 | A | 10/1980 | Saito et al. |
| 4,273,786 | A | 6/1981 | Kraskin |
| 4,312,634 | A | 1/1982 | Katz |
| 4,314,854 | A | 2/1982 | Takagi |
| 4,337,060 | A | 6/1982 | Dalmas |
| 4,363,322 | A | 12/1982 | Andersson |
| 4,372,309 | A | 2/1983 | Fowler |
| 4,382,919 | A | 5/1983 | Alonso et al. |
| 4,401,712 | A | 8/1983 | Morrison |
| 4,410,397 | A | 10/1983 | Kempf |
| 4,459,174 | A | 7/1984 | Papageorges et al. |
| 4,462,864 | A | 7/1984 | Carles et al. |
| 4,494,482 | A | 1/1985 | Arnold |
| 4,517,919 | A | 5/1985 | Benjamin et al. |
| 4,533,435 | A | 8/1985 | Intili |
| 4,583,980 | A | 4/1986 | Schneider et al. |
| 4,610,678 | A | 9/1986 | Weisman et al. |
| 4,614,646 | A | 9/1986 | Christiansen |
| 4,619,663 | A | 10/1986 | Tatin |
| 4,626,319 | A | 12/1986 | Kruger et al. |

(Continued)

FOREIGN PATENT DOCUMENTS

| | | |
|---|---|---|
| EP | 348978 | 1/1990 |
| EP | 510619 | 10/1992 |
| EP | 1034802 | 9/2000 |
| JP | 4-17058 | 3/1992 |
| JP | 4/17058 | 3/1992 |
| WO | WO 89/02698 | 4/1989 |
| WO | WO 90/07501 | 7/1990 |
| WO | WO 91/11977 | 8/1991 |
| WO | WO 91/12029 | 8/1991 |
| WO | WO 91/12030 | 8/1991 |
| WO | WO 94/22501 | 10/1994 |
| WO | WO 97/00354 | 1/1997 |
| WO | WO 99/06078 | 2/1999 |
| WO | WO 99/32697 | 7/1999 |
| WO | WO 01/48025 | 7/2001 |

OTHER PUBLICATIONS

Electronic Mail Message from Elson Silva, Ph.D., dated May 3, 2006 with alleged explanation of relevance. [Note: Applicants and their counsel did not prepare, modify or otherwise alter this explanation, which was apparently prepared by Dr. Silva, and therefore expressly disclaim any representation(s) regarding the accuracy of that explanation.].

*Primary Examiner* — Lynda Salvatore
(74) *Attorney, Agent, or Firm* — Hunton & Williams LLP

(57) ABSTRACT

An odor-inhibiting fiber having a cellulosic fiber and an odor-inhibiting formulation. The odor-inhibiting formulation may contain an odor-inhibiting agent, such as a biocide, an enzyme, a urease inhibitor. The odor-inhibiting formulation also may contain a liquid carrier such as a hydrophobic or hydrophilic organic liquid, or a mixture of a hydrophobic and hydrophilic organic liquid. The cellulosic fiber is impregnated with the odor-inhibiting formulation to produce fiber having odor-inhibiting characteristics. The resultant odor-inhibiting fiber is useful in making absorbent articles with odor-inhibiting characteristics. The fiber of the embodiments prevents odor by inhibiting bacteria growth and ammonia production, especially when used in an absorbent article such as a diaper or adult incontinence device.

52 Claims, 4 Drawing Sheets

U.S. PATENT DOCUMENTS 4,657,537 A 4/1987 Zimmerer
4,666,975 A 5/1987 Yamasaki et al.
4,675,076 A 6/1987 Darlington
4,692,374 A 9/1987 Bouchette
4,721,059 A 1/1988 Lowe et al.
4,731,161 A 3/1988 Ehrhardt
4,732,650 A 3/1988 Michalowski et al.
4,756,798 A 7/1988 Lachenal et al.
4,801,404 A 1/1989 Dietrich et al.
4,842,593 A 6/1989 Jordan et al.
4,847,088 A 7/1989 Blank
4,863,445 A 9/1989 Mayhan et al.
4,908,456 A 3/1990 Farina et al.
4,915,785 A 4/1990 Siminoski et al.
4,975,109 A 12/1990 Friedman, Jr. et al.
4,992,326 A 2/1991 Dabi
5,031,578 A 7/1991 Hammons et al.
5,071,622 A 12/1991 Dunson, Jr.
5,143,581 A 9/1992 Devic
5,223,091 A 6/1993 Hetzler et al.
5,230,958 A 7/1993 Dabi
5,242,435 A * 9/1993 Murji et al. ..... 604/374
5,248,389 A 9/1993 Heimburger et al.
5,281,207 A 1/1994 Chmielewski et al.
5,296,100 A 3/1994 Devic
5,306,392 A 4/1994 Mita
5,389,202 A 2/1995 Everhart et al.
5,405,862 A 4/1995 Farina et al.
5,464,563 A 11/1995 Moore et al.
5,464,851 A 11/1995 Morpeth
5,541,233 A 7/1996 Roenigk
H1579 H 8/1996 Furio
5,543,215 A 8/1996 Hansen et al.
5,547,541 A 8/1996 Hansen et al.
5,547,985 A 8/1996 Brown-Skrobot et al.
5,562,740 A 10/1996 Cook et al.
5,591,304 A 1/1997 Tolan et al.
5,614,570 A 3/1997 Hansen et al.
5,616,280 A 4/1997 Moore et al.
5,643,971 A 7/1997 Roenigk
5,686,088 A 11/1997 Mitra et al.
5,702,585 A 12/1997 Hillrichs et al.
5,728,263 A 3/1998 Mattila et al.
H1732 H 6/1998 Johnson
5,821,271 A 10/1998 Roenigk
5,856,248 A 1/1999 Weinberg
5,869,027 A 2/1999 Wood et al.
5,885,412 A 3/1999 Paart et al.
5,944,704 A 8/1999 Guarracino et al.
5,968,852 A 10/1999 Vlasblom
5,998,026 A 12/1999 Ramachandran
6,015,816 A 1/2000 Kostyniak et al.
6,025,186 A 2/2000 Kirk et al.
6,068,620 A 5/2000 Chmielewski
6,074,631 A 6/2000 Tsuchiya et al.
6,080,908 A 6/2000 Guarracino et al.
6,149,767 A 11/2000 Hermans et al.
6,187,141 B1 2/2001 Takeuchi et al.
6,203,810 B1 3/2001 Alemany et al.
6,203,899 B1 3/2001 Hirose et al.
6,207,012 B1 3/2001 Oriaran et al.
6,229,062 B1 5/2001 Mandell et al.
6,245,693 B1 6/2001 Gagliardi et al.
6,251,381 B1 6/2001 Kourai et al.
6,284,259 B1 9/2001 Beerse et al.
6,288,076 B1 9/2001 Kostyniak et al.
6,319,356 B1 11/2001 Durkes et al.
6,325,969 B1 12/2001 Aamodt et al.
6,342,653 B1 1/2002 Gancet et al.
6,375,967 B1 4/2002 Bedue et al.
6,380,152 B1 4/2002 Julemont et al.
6,417,424 B1 7/2002 Bewick-Sonntag et al.
6,432,262 B1 8/2002 Ney et al.
6,437,212 B1 8/2002 LaFortune
6,458,343 B1 10/2002 Zeman et al.
6,468,517 B2 10/2002 Moscherosch
6,476,104 B1 11/2002 Nakamura et al.
6,482,423 B1 11/2002 Beerse et al.
6,569,439 B1 5/2003 Stier
6,616,922 B2 9/2003 Taylor et al.
6,649,805 B1 11/2003 Carlucci et al.
6,653,264 B1 11/2003 Sundman et al.
6,699,358 B1 3/2004 Francis et al.
6,700,032 B1 3/2004 Gray
6,703,536 B2 3/2004 Roe et al.
6,712,121 B2 3/2004 Clark et al.
6,716,310 B2 4/2004 Sun et al.
6,730,819 B1 5/2004 Pesce
6,733,625 B2 5/2004 Henricson et al.
6,766,817 B2 7/2004 Da Silva
6,797,856 B1 9/2004 Kolb et al.
6,821,042 B2 11/2004 Baker et al.
6,821,383 B2 11/2004 Shore et al.
6,825,392 B2 11/2004 Baker
6,844,066 B2 1/2005 Hamed
6,852,100 B1 2/2005 Gent et al.
6,852,312 B2 2/2005 Worley et al.
6,852,904 B2 * 2/2005 Sun et al. ..... 604/359
6,855,134 B2 2/2005 Brooks
6,863,826 B2 3/2005 Sheets
6,866,870 B2 3/2005 Day
6,867,343 B2 3/2005 La Fortune
6,884,766 B2 4/2005 DeClercq et al.
6,890,481 B2 5/2005 Aamodt et al.
6,916,402 B2 7/2005 Shannon et al.
6,923,887 B2 8/2005 Pan
6,927,237 B2 8/2005 Hei et al.
6,960,702 B1 11/2005 Kawakami et al.
6,962,608 B1 11/2005 Sun et al.
6,965,002 B2 11/2005 Usuki et al.
6,977,082 B2 12/2005 Seitz, Jr. et al.
7,118,759 B2 10/2006 Syverson et al.
7,154,018 B2 12/2006 Koenig et al.
7,226,607 B2 * 6/2007 Uchiyama et al. ..... 424/401
2002/0115581 A1 * 8/2002 DuVal et al. ..... 510/276
2003/0100871 A1 5/2003 Mauro et al.
2004/0122387 A1 * 6/2004 Long et al. ..... 604/360
2005/0079361 A1 4/2005 Hamed et al.
2005/0113448 A1 5/2005 Syverson et al.
2006/0029567 A1 2/2006 Dutkiewicz
2007/0077428 A1 * 4/2007 Hamed et al. ..... 428/393

* cited by examiner

CELLULOSIC FIBERS WITH ODOR CONTROL CHARACTERISTICS

BACKGROUND

1. Field

The embodiments generally relate to cellulosic fibers with odor controlling characteristics. More particularly, the embodiments relate to cellulosic fibers impregnated with an odor-controlling formulation. The embodiments further relate to a method for applying the odor-controlling agent to cellulosic fibers. Cellulosic fibers produced according to the embodiments are suitable for use in a wide variety of absorbent articles intended for body waste management such as undergarments for those suffering from incontinence, feminine shields, baby diapers, bedding products such as mattress pads and covers, wipes, and medical gowns. The embodiments also provide a process of manufacturing an absorbent article comprising the cellulosic fiber of the embodiments.

2. Description of Related Art

Cellulosic fibers are used in a wide variety of personal care products. These range from absorbent articles such as personal hygiene products to wipes or pads used in medical and food handling applications. While the design of personal care products varies depending upon intended use, there are certain elements or components common to such products. For instance, absorbent articles intended for personal care, such as adult incontinent pads, feminine care products, and infant diapers typically are comprised of at least a top sheet, a back sheet, and an absorbent core. The absorbent core is typically comprised of cellulosic fibers and superabsorbent materials distributed among the fibers.

Designers of absorbent articles have generally designed products responsive to consumer demands for less bulky, and less expensive absorbent articles having a high absorption rate and high capacity. As a result, absorbent article designs have become progressively thinner, using various absorbent polymers with high absorptive power. For example, the thickness of a feminine hygiene pad has been reduced from about 15 mm to 20 mm in the mid 1980's to about 2.5 mm to 6 mm today. In addition, absorbent article designs have incorporated other materials to improve absorbency and efficiency of the product, such as, for example, an acquisition-distribution layer, typically located between the top sheet and the absorbent core, to accelerate liquid acquisition times, and reduce product wetness.

In recent years product designers have shifted their design focus to addressing aesthetic and skin-wellness issues, including the removal of unpleasant odors, and the prevention of skin diseases such as dermatitis, rash and redness caused by wearing a disposable absorbent article for a relatively long time. It is believed that the unpleasant odors in an absorbent article originate from numerous sources including bodily fluids such as urine and menses absorbed by the absorbent articles. Degradation of the components present in these fluids (e.g., protein, fat, etc.) can generate malodorous byproducts. In addition, urine and/or other exudates usually contain microorganisms that produce the urease enzyme that is responsible for the degradation of urea present in urine to ammonia. The ammonia, in turn, has the potential to cause dermatitis, rash and/or other forms of skin irritation. For an infant, these conditions can be a serious medical issue which, in extreme cases, can result in death.

There have emerged two general categories of absorbent article technologies for removal of odors and improvement of skin wellness: (1) odor absorption technology; and (2) anti-microbial treatment technology. The odor absorption technology includes incorporation into the absorbent article of compounds that are known to absorb odors, such as activated carbons, clays, zeolites, silicates, cyclodextrine, ion exchange resins and various mixture thereof as for example described in EP-A-348 978; EP-A-510 619, WO 91/12029; WO 91/11977; W089/02698; WO 91/12030; WO 94/22501; WO 99/06078; and WO 01/48025 (the contents of each of these applications is incorporated herein by reference in their entirety). For example, a relatively recent and widely used odor absorbing agent for odor control is cyclodextrin. Cyclodextrins are ring-shaped sugar molecules with a hydrophilic surface and an empty hydrophobic cavity. Cyclodextrins, like other odor absorbing agents, control odor by mechanisms whereby the malodorous compounds and their precursors are physically absorbed by the agents. The agents thereby hinder the exit of the malodorous compounds from absorbent articles. However, such mechanisms are not completely effective because the formation of the odor itself is not prevented, and thus some odor still may be detected in the product. Also, it is believed that the odor absorbing particles lose odor-trapping efficiency when they become moist, as most absorbent articles do. Furthermore, in order for these reagents to be effective at controlling odor, a high loading of these reagents is required which increases the cost of the absorbent article, and tends to adversely affect the absorbency and performance of the absorbent article.

The second category of odor-removal and skin wellness technology involves introducing anti-microbial agents into the absorbent article either by physical or chemical methods. An example of such approach is described in patent WO99/32697 (which is incorporated herein by reference in its entirety), which discloses coating a nonwoven fabric of hydrophobic material (e.g., polypropylene fibers) with an anti-microbial agent chitosan and chitin-based polymers. The anti-microbial agent is applied to the surface of the fabric, and the resulting treated fabric is used as a diaper liner to reduce odor and promote skin wellness. It is believed, however, that such technology is very limited in preventing odor formation, since the anti-microbial agent is located outside the body fluid accumulation zone—i.e., the absorbent core of the absorbent article.

The use of an anti-microbial agent in an absorbent article also is described in Japanese Patent No. 4-17058 (incorporated herein by reference in its entirety). This patent discloses a disposable diaper that is said to prevent the occurrence of diaper rash caused by certain bacteria such as *colibacillus* and *Candida* and to inhibit the production of ammonia (formed by hydrolysis of the urea contained in the urine) by bacteria. The disclosed disposable diaper consists of a water-permeable top sheet, a water-impermeable back sheet, and a water-absorbent layer sandwiched between these sheets. The water-absorbent layer has an ammonia-adsorbent and a water-absorbent polymer that contains an anti-microbial agent such as benzalkonium chloride and/or chlorhexidine gluconate.

It is believed, however, that using surfactant-based anti-microbial agents or bactericides poses some disadvantages. One drawback is that surfactant-based anti-microbial agents tend to reduce the absorbency and the wettability of the absorbent layer, thereby causing a significant re-wet or leakage problem in absorbent article. It is also believed that surfactant-based anti-microbial agents are only effective in reducing certain bacterial activity, and have only limited anti-microbial properties.

The description herein of certain advantages and disadvantages of known odor-reducing and anti-microbial agents for use in absorbent articles, and methods of their preparation, is not intended to limit the scope of the present invention.

Indeed, the present invention may include some or all of the methods and materials described above without suffering from the same disadvantages.

SUMMARY

Based on the foregoing, there remains a need in the art for a cellulosic fiber capable of inhibiting odors caused by the growth of bacteria present in bodily fluids, where the fiber has activity toward a wide range of bacteria, and is capable of maintaining odor-inhibiting activity over extended periods. There is also a need for an absorbent article containing such odor-inhibiting cellulosic fiber without sacrificing the characteristic low cost, high performance and low bulk associated with the absorbent articles.

It therefore is a feature of the embodiments described herein to provide a simple, relatively inexpensive, odor-inhibiting fiber suitable for use in absorbent articles, that is capable of inhibiting the odors caused by growth of bacteria present in bodily fluids without affecting the liquid transport property and absorbency of such fiber. It also is a feature of the embodiments to provide a process for making the odor-inhibiting fibers in sheet form that provides time and cost savings to both the cellulose fiber manufacturers and the manufacturers of the absorbent article. The embodiments described herein desire to fulfill these needs and to provide further related advantages, that will be readily appreciated by those skilled in the art.

Thus, one embodiment provides an odor-inhibiting fiber comprising a cellulosic fiber and an odor-inhibiting formulation. It is a feature of an embodiment that the odor-inhibiting formulation comprises an odor-inhibiting agent. It is a feature of an embodiment that the odor-inhibiting agent may comprise a biocide, an enzyme, a urease inhibitor, or combinations and mixtures thereof. It is a feature of an embodiment that the odor-inhibiting formulation comprises a liquid carrier. The liquid carrier may comprise either a hydrophobic or a hydrophilic liquid carrier, or a mixture thereof.

Another embodiment provides a method for manufacturing cellulosic fibers having an odor-inhibiting agent. The method includes: (a) providing an odor-inhibiting formulation; (b) providing a cellulosic fiber; and (c) impregnating the cellulosic fiber with the odor-inhibiting formulation. It also is a feature of an embodiment to provide an absorbent article that includes the odor-inhibiting fiber.

These and other objects, features and advantages of the embodiments will appear more fully from the following detailed description of the preferred embodiments of the invention.

BRIEF DESCRIPTION OF THE DRAWINGS

The embodiments presented herein can be understood more completely by reading the following detailed description, in conjunction with the accompanying drawings, in which.

DETAILED DESCRIPTION OF EMBODIMENTS

Figure 1:
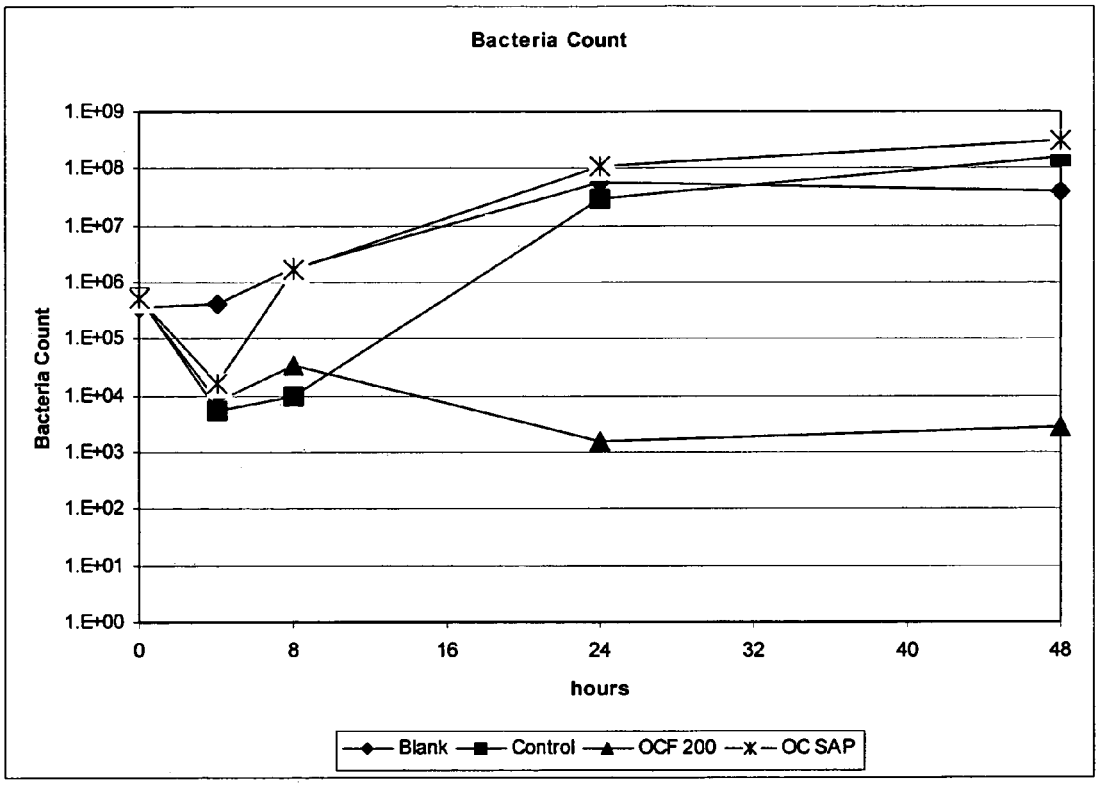
FIG. 1 is a graph showing bacteria count over a 48-hour test period, for an odor-inhibiting fiber sample made according to the Example, a blank, a control and odor control SAP (OC SAP)

The embodiments relate generally to cellulosic fibers having odor-inhibiting properties, and more particularly to fibers having an odor-inhibiting agent that remains with the fiber after it is incorporated into an absorbent article. Other embodiments relate to an odor-inhibiting formulation suitable for making the fiber of the embodiments.

The cellulosic fiber made in accordance with the embodiments is especially suited for use in absorbent articles intended for body waste management. One advantage of using the cellulosic fiber of the embodiments in absorbent article is that the fiber has the ability to eliminate or suppress the growth of microorganisms present in bodily fluids that are accountable for the breakdown of urea into ammonia. The resultant absorbent article is substantially odor-free.

As used herein, the terms and phrases "absorbent garment," "absorbent article" or simply "article" or "garment" refer to mechanisms that absorb and contain bodily fluids and other body exudates. More specifically, these terms and phrases refer to garments that are placed against or in proximity to the body of a wearer to absorb and contain the various exudates discharged from the body. A non-exhaustive list of examples of absorbent garments includes diapers, diaper covers, disposable diapers, training pants, feminine hygiene products and adult incontinence products. Such garments may be intended to be discarded or partially discarded after a single use ("disposable" garments). Such garments may comprise essentially a single inseparable structure ("unitary" garments), or they may comprise replaceable inserts or other interchangeable parts.

The embodiments may be used with all of the foregoing classes of absorbent garments, without limitation, whether disposable or otherwise. Some of the embodiments described herein provide, as an exemplary structure, a diaper for an infant, however this is not intended to limit the embodiments. The embodiments will be understood to encompass, without limitation, all classes and types of absorbent garments, including those described herein.

Throughout this description, the terms "impregnated" or "impregnating" insofar as they relate to an odor-inhibiting formulation impregnated in a fiber, denote an intimate mixture of the odor-inhibiting formulation and cellulosic fluff pulp fiber, whereby the odor-inhibiting formulation may be adhered to the fibers, adsorbed on the surface of the fibers, or linked via chemical, hydrogen or other bonding (e.g., Van der Waals forces) to the fibers. Impregnated in the context of the embodiments does not necessarily mean that the odor-inhibiting formulation is physically disposed beneath the surface of the fibers.

Embodiments described herein relate to cellulosic fibers in sheet or fluff form with odor-inhibiting properties. As used herein, the phrase "odor-inhibiting" refers to the ability of a formulation, agent, fiber, or the like, to reduce, prevent, inhibit, or eliminate odor. The cellulosic fibers of the embodiments are useful in absorbent articles, and in particular, are useful in forming absorbent cores of absorbent articles. The particular construction of the absorbent article is not critical to the embodiments, and any absorbent article can benefit from the embodiments. Suitable absorbent garments are described, for example, in U.S. Pat. Nos. 5,281,207, and 6,068,620, the disclosures of each of which are incorporated herein by reference in their entirety including their respective drawings. Those skilled in the art will be capable of utilizing cellulosic fibers of the embodiments in absorbent garments, cores, acquisition layers, and the like, using the guidelines provided herein.

In one embodiment, an odor-inhibiting formulation useful in making fiber preferably is composed of odor-inhibiting agent and a liquid carrier. The liquid carrier may be hydrophobic or hydrophilic. A suitable hydrophobic liquid carrier is an organic liquid that is sparingly soluble in water. As used herein, the phrase "sparingly soluble" refers to an organic solvent that is soluble in water to an extent of less than about 20 weight %, preferably less than about 10 weight %, more preferably less than about 5 weight %, and most preferably less than about 3 weight %. However, a sparingly soluble solvent may be miscible with hydrophilic solvents other than water. A suitable hydrophilic liquid carrier is a liquid solvent with solubility of more than 10% in water and capable of forming hydrogen bonds with cellulose fibers and odor-inhibiting agents, especially those having sites capable of forming hydrogen bonds.

The liquid carrier preferably is hydrophobic, because it is believed that hydrophobic liquid carriers result in a more uniform distribution of odor-inhibiting agent on the fiber, and provide better penetration of the odor-inhibiting agent into the interior part of the fiber. Without being limited to a specific theory, it is believed that this is because a hydrophobic carrier (e.g., triacetin) does not swell the fiber; instead it travels throughout the pores and among the fibers, enabling even distribution of odor-inhibiting agent on the fibers. Mixtures of two or more of hydrophilic and hydrophobic liquid carriers are also suitable for use in the embodiments so long as the mixture forms a substantially clear solution with the odor-inhibiting agent.

Hydrophobic liquid carriers useful in the embodiments include the ethers and the esters of polyhydric alcohols, preferably having an alkyl moiety of 3 or more carbon atoms. The alkyl moiety may include saturated, unsaturated (e.g., alkenyl, alkynyl, allyl), substituted, un-substituted, branched, un-branched, cyclic, and/or acyclic compounds. Examples of suitable hydrophobic liquid carriers include triacetin, diacetin, propylene carbonate, tri(propylene glycol) butyl ether, di(propylene glycol) butyl ether, di(propylene glycol) dimethyl ether, propyleneglycol diacetate, phenethyl acetate pentaerythritol, pentaerythritol ethoxylate, pentaerythritol propoxylate tri(propylene glycol), di(propylene glycol), tri (propylene glycol) methyl ether, poly(ethylene glycol) methyl ether, 2-phenoxyethanol, phenethyl alcohol, and combinations and mixtures of thereof.

Examples of other suitable hydrophobic liquid carriers include cyclic or linear liquid silicone, mineral oil, paraffins, isoparaffins, and fatty acid esters such as isopropyl myristate, lauryl myristate, isopropyl palmitate, diisopropyl sebecate, diisopropyl adipate.

Hydrophilic liquid carriers suitable for use in the embodiments include monohydric and polyhydric alcohols having an alkyl group with two or more carbon atoms such as ethyl, propyl, or butyl alcohols, lauryl or soya alcohols, 1,2 cyclohexanedimethanol, 1,3-cyclohexanedimethanol, 1,4-cyclohexanedimethanol (1,4-CHDM), ethylene glycol, butanediol, pentanediol, diethylene glycol, triethylene glycol, hexanetriol, glycerol, trimethylol ethane, trimethylol propane, pentaerythritol and various polyethylene glycols and polypropylene glycols. The polymeric products of polyhydric alcohols such as polyethylene glycol and polypropylene glycol are also suitable for use in the embodiments. Other suitable hydrophilic liquid carriers are water and amino alcohols such as ethanolamine, diethanolamine, and diglycolamine.

Particularly preferred liquid carriers include 1,4-CHDM, triacetin, diacetin, propylene carbonate, polyethylene glycol, and polypropylene glycol, because these liquid carriers do not tend to adversely affect the absorbency or wettability of the treated cellulosic fibers.

Other carriers suitable for use in the present invention include those able to covalently bond to cellulosic fibers or both to cellulosic fibers and to the odor-inhibiting agent. Examples of these carriers include mono- and poly-functional epoxies, mono- and poly-functional aldehydes, and ketones. Especially preferred carriers are those that are liquid at room temperature. Examples of these carriers include: 1,4-cyclohexanedimethanol diglycidyl ether, diglycidyl 1,2-cyclohexanedicarboxylate, glycerol propoxylate triglycidyl ether, 1,4-butanediol diglycidyl ether, neopentyldiglycidyl ether, polypropyleneglycol diglycidyl ether, glyoxal, glutaraldehyde, and glyceraldehydes, and any mixture or combination thereof.

Preferably the liquid carrier is present in the odor-inhibiting formulation at a concentration ranging from about 1 weight % to about 99 weight % based on the total weight of the odor-inhibiting formulation. More preferably the odor-inhibiting formulation comprises from about 5 weight % to about 90 weight % liquid carrier.

In one embodiment, the liquid carrier comprises a mixture of a hydrophobic liquid carrier and a hydrophilic liquid carrier in a ratio (hydrophobic carrier to hydrophilic carrier) ranging from about 1:10 by weight to about 10:1 by weight. For example, the liquid carrier may comprise a mixture of triacetin and 1,4-cyclohexanedimethanol (1,4-CHDM).

Throughout this description, the expression "odor-inhibiting agent" is used to describe material capable of reducing, preventing, inhibiting, or eliminating odor by destroying or suppressing the growth or reproduction of microorganisms present in bodily fluids accountable for odor, rashes and skin irritation, such as bacteria present in urine. The expression "odor-inhibiting agent" also relates to an agent capable of inhibiting urease activities.

In one embodiment, the odor-inhibiting agent is a biocide, an enzyme, a urease inhibitor, or a combination or a mixture thereof. The odor-inhibiting agents of the various embodiments operate on bacteria in different ways, such as inhibiting the cell wall synthesis or repair, altering cell wall permeability, inhibiting protein synthesis, and/or inhibiting synthesis of nucleic acids. For example, fatty amines (e.g., CETAVLON) penetrate the cell wall of a micro-organism thereby totally eradicating the micro-organism. Other odor-inhibiting agents mentioned in the embodiments may operate by inhibiting the action of enzymes, for instance, they may prevent urease, an enzyme produced by bacteria in urine, from hydrolyzing urea to ammonia.

Regardless of the mechanism by which the odor-inhibiting agent operates, the main purpose of using such an agent is to prevent the hydrolysis of urea and the release of ammonia by eliminating the micro-organisms or by blocking the urease enzyme. The hydrolysis of urea to ammonia by urease is shown in scheme 1 below. (For more details about the mechanism of hydrolysis see Terman, "Volatilization Losses of Nitrogen as Ammonia From Surface Applied Fertilizers, Organic Amendments, and Crop Residues," Adv. Agronomy 31:189-223, 1979; and Freney et al., "Volatilization of Ammonia," Gaseous Loss of Nitrogen from Plant Soil-Systems (Freney and Simpson eds., Martinus and Nijhoff, 1983)).

Scheme 1

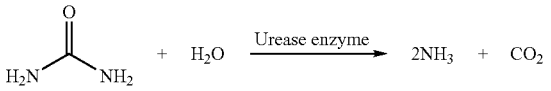

Examples of biocides suitable for use in the embodiments include peroxides, peracids, glutaraldehyde, analides ($C_6H_5NHCOR$), biguanide such as, for example, 1,1'-hexamethylene-bis-[5-(p-chlorphenyl)-biguanide], hexachlorophene, 1-(alkylamino)-3-amino-propane, 2-bromo-2-nitro-1,3-propanediol, phenoxyethanol, benzyl alcohol, 2-hydroxymethylaminoethanol, n-2-hydroxypropylaminomethanol, 2-hydroxypropyl methanethiosulfonate, p-nitrophenol, 4-chloro-3,5-dimethylphenol, 5-chloro-2-(2,4-dichlorophenoxy)phenol, trichlorocarbanalide, hexachlorophene, chlorhexidine, o-phenylphenol, benzylquaternium salts, 4-hydroxybenzoic acid and its salts with alkali or alkaline earth metals or its esters with linear or branched $C_{1-10}$ alcohols, N-(4-chlorophenyl)-N'-(3,4-dichlorophenyl)-urea, 2,4,4'-trichloro-2'-hydroxy diphenyl ether (triclosan), 4-chloro-3,5-dimethyl phenol, 2,2'-methylene-bis-(6-bromo-4-chlorophenol), 3-methyl-4-(1-methylethyl)-phenol, 2-benzyl-4-chlorophenol, 3-(4-chloropenoxy)-propane-1,2-diol, 3-iodo-2-propinyl butyl carbamate, chlorohexidine, 3,4,4'-trichlorocarbanilide (TTC), piroctone ethanolamine salt (commercially available under the trade name OCTOPIROX from the Clariant Corporation, Mount Holly (West) N.J.), tetracycline, 3,4,4'-trichlorobanilide, chitosan or chitin derivatives, diglycerol monocaprate (DMC), zinc salts such as, for example, zinc glycinate, zinc lactate or zinc phenol sulfonate, phytosphingosines, dodecane-1,2-diol, 3,7,11-trimethyldodeca-2,6,10-trienol (farnesol), undecylenic acid, its salts with alkali or alkaline earth metals or its esters with linear or branched $C_{1-10}$ alcohols, salicylic acid-N-alkyl amides where the alkyl groups contain 1 to 22 carbon atoms linear or branched, hydantoins such as those discussed in U.S. Pat. No. 6,852,312 (the disclosure of which is incorporated herein by reference in its entirety), and other biocide compositions such as those disclosed in U.S. Pat. Nos. 6,863,826 and 6,866,870 (the disclosures of which are incorporated herein by reference in their entirety). A suitable biocide also may comprise any combinations and mixtures of the foregoing examples. Other biocides suitable for use in the embodiments include fatty amines such as hexadecyltrimethyl ammonium bromide (commercially known as CETAVLON), cetyltrimethyl ammonium bromide, and N-hexadecylpyridinium chloride.

Particularly preferred biocides for use in the embodiments are peroxides, salicylic acid-N-octyl amide and/or salicylic acid-N-decyl amide, triclosan, 4-chloro-3,5-dimethylphenol, OCTOPIROX, tetracycline, 3,4,4'-trichlorobanilide; and CETAVLON.

Examples of suitable peroxides for use in the embodiments include hydrogen peroxide and materials that produce hydrogen peroxide on dissolution in water such as, for example, hydrated sodium perborate and hydrogen peroxide complexes or adducts such as hydrogen peroxide-sodium carbonate, hydrogen peroxide-urea, hydrogen peroxide-nylon-6, hydrogen peroxide-polyvinylpyrrolidine, and hydrogen peroxide-1,3-dimethylurea. Other suitable hydrogen peroxide generators are enzymes such as, for example, peroxidases and oxidases.

In embodiments in which hydrogen peroxide is used as an odor-inhibiting agent, preferably the hydrogen peroxide is mixed with a stabilizing agent to improve the stability of the hydrogen peroxide, because peroxides are known to have limited stability. Suitable stabilizing agents include a transition metal chelator or a picolinic acid such as the one described in PCT Patent Application No. WO 90/07501 (the disclosure of which is incorporated herein by reference in its entirety) as a stabilizer for peroxycarboxylic acid bleaching composition. Other suitable hydrogen peroxide stabilizing agents include phosphate, sulfate, and silicate salts of sodium, magnesium, potassium, and calcium. The salts may be hydrated or anhydrated. Examples of such salts include sodium phosphate, potassium phosphate, sodium silicate, magnesium sulfate, and sodium sulfate.

Other suitable peroxide stabilizers include organic acids, preferably those with multicarboxyl groups such as oxalic acid, malonic acid, succinic acid, maleic acid, lactic acid, adipic acid, tartaric acid, citric acid, and combinations mixtures thereof. A mixture of organic and inorganic acids may be suitable for use as a peroxide stabilizer.

A peroxide stabilizer is an important component of the embodiments in which peroxide is used as an odor-inhibiting agent. Preferably, a stabilizer is present in the odor-inhibiting formulation at a concentration of about 0.01 weight % to about 20 weight %, more preferably from about 0.1 weight % to about 10 weight %, and even more preferably from about 0.5 weight % to about 1 weight %, based on the total weight of the formulation. Preferably, the stabilizer and peroxide are present in a molar ratio of about 1:10 to about 10:1, of stabilizer to peroxide.

Urease inhibitors are another type of odor-inhibiting agent suitable for use in the embodiments. Examples of suitable urease inhibitors include N-(n-butyl)thiophosphoric triamide, cyclohexylphosphoric triamide, and phenyl phosphorodiamidate. Other suitable urease inhibitors include alkali metal fluorides, alkali metal bisulfites, such as sodium bisulfite, alkali metal borates (sodium tetraborate) and boric acid. Another suitable urease inhibitor is Yucca schidigera sold as a solution under the trade name YUCCA 70 by Sher-Mar Enterprises, Poway, Calif.

The urease inhibitor used in the embodiments preferably is phenyl phosphorodiamidate. More preferably, the urease inhibitor is applied in combination with an organic acid, such as those mentioned earlier. It is believed that the combination of the urease inhibitor with an organic acid provides multiple benefits, including controlling odors by inhibiting the enzymatic breakdown of urea to ammonia, and lowering the pH of the treated fiber, thereby neutralizing the basic compounds present in urine, such as ammonia and amines.

Enzymes, especially those that have the ability to attack the protective cell walls of bacteria, also may be advantageously employed in making the odor-inhibiting formulation of the embodiments. An example of a suitable enzyme is lysozyme, which is found in egg whites and tears. Lysozyme tends to attack the protective cell walls of bacteria, and destroy the structural integrity of the cell wall. The bacteria then split open under their own internal pressure.

Another embodiment provides a method for making cellulosic fibers having odor-inhibiting activity, by impregnating a cellulosic base fiber with the odor-inhibiting formulation of the embodiments. The odor-inhibiting formulation may be prepared by any suitable and convenient procedure. Preferably, the odor-inhibiting formulation contains an odor-inhibiting agent in an effective amount. The expression "effective amount" as used herein is defined as a level sufficient to prevent odor in an absorbent article (e.g., a diaper) or to prevent growth of micro-organisms present in urine, for a predetermined period of time.

In accordance with a specific embodiment, the odor-inhibiting formulation can be prepared by dissolving an odor-inhibiting agent in a liquid carrier or in a mixture of liquid carriers. Preferably, the odor-inhibiting agent makes up about 0.1 weight % to about 50 weight % of the odor-inhibiting formulation, based on the total weight of the odor-inhibiting formulation. More preferably, the odor-inhibiting agent makes up about 1 weight % to about 25 weight %, and most preferably comprises about 2 weight % to about 15 weight % of the odor-inhibiting formulation. In one embodiment, the odor-inhibiting formulation comprises from about 0.1 weight % to about 50.0 weight % of an odor-inhibiting agent, and from about 50.0 weight % to about 99.9 weight % of a liquid carrier. In another embodiment, the odor-inhibiting formulation comprises from about 1.0 weight % to about 15.0 weight % of an odor-inhibiting agent and from about 85.0 weight % to about 98.0 weight % of a liquid carrier.

In a preferred embodiment, odor-inhibiting agents with hydrophobic properties are dissolved in a liquid carrier or a mixture of liquid carriers with hydrophobic characteristics. For example, an odor-inhibiting agent with hydrophobic characteristics (e.g., triclosan) preferably is dissolved in a hydrophobic liquid carrier such as triacetin or in a liquid carrier with some hydrophobic characteristics such as for instance polypropylene glycol. Odor-inhibiting agents with hydrophilic characteristics (e.g., hydrogen peroxide) preferably are dissolved in a liquid carrier having hydrophilic characteristics, such as water, polypropylene glycol or a mixture of both. The odor-inhibiting formulation of the embodiments preferably is a clear and homogenous solution.

In some embodiments, particularly those directed to odor-inhibiting formulations comprising hydrogen peroxide or a substance that generates hydrogen peroxide on dissolution in water and a stabilizing agent, it is preferred that the formulation is prepared by first dissolving the stabilizing agent and hydrogen peroxide or hydrogen peroxide generator in water, and then diluting them to a desirable concentration with a liquid carrier other than water. Preferably, the non-water liquid carrier is a mixture of liquid carriers with different characteristics, such as a mixture of triacetin and polypropylene glycol. Preferably, the amount of water in the odor-inhibiting formulation is less than about 50 weight %, more preferably less than about weight 20%, and most preferably less than about 10 weight % of the liquid carrier of the formulation.

The odor-inhibiting formulation can be added to the fluff pulp so that a predetermined amount of the odor-inhibiting agent is provided to the fiber. In other words, the amount of odor-inhibiting formulation to be added to the fluff pulp depends upon the concentration of the odor-inhibiting agent in the formulation, and the desired ratio of odor-inhibiting agent to fiber. Using the guidance provided herein, one of ordinary skill in the art will be able to determine how much of the odor-inhibiting formulation to add to the fluff to provide the desired amount of the odor-inhibiting agent to the fiber.

The odor-inhibiting formulation also may include other additives such as, for example, odor absorbents. Examples of suitable odor absorbents include baking soda, talcum powder, cyclodextrin, ethylenediamine tetra-acetic acid or other chelating agents, zeolites, activated silica, or activated carbon granules. The odor-inhibiting formulation preferably comprises about 0.1 weight % to about 20 weight % of an odor absorbent based on the total weight of the odor-inhibiting formulation.

The odor-inhibiting formulation also may include material able to function as a bonding mediator between the cellulosic fibers and the odor-inhibiting agents. Especially preferred materials include those with hydrogen bonding sites. The material can be organic or inorganic. Examples of suitable materials include amino acids, aluminum hydroxide, and boron hydroxide.

As used herein, the expression "cellulosic fibers" refer to those cellulosic fluff pulps that are conventionally employed to form a web for use, for example, in absorbent articles. Any cellulosic fluff pulp can be used, so long as it provides the physical characteristics of the fibers described herein. Suitable cellulosic fluff pulps for use in the embodiments include those derived primarily from wood pulp. Suitable wood pulp can be obtained from any of the conventional chemical processes, such as the Kraft and sulfite processes. Preferred fibers are those obtained from various soft wood pulp such as Southern pine, White pine, Caribbean pine, Western hemlock, various spruces, (e.g. Sitka Spruce), Douglas fir or mixtures and combinations thereof. Fibers obtained from hardwood pulp sources, such as gum, maple, oak, eucalyptus, poplar, beech, and aspen, or mixtures and combinations thereof also may be used, as well as other cellulosic fiber derived form cotton linter, bagasse, kemp, flax, and grass. The cellulosic fiber can be comprised of a mixture of two or more of the foregoing cellulose pulp products. Particularly preferred fibers for use in the embodiments are those derived from wood pulp prepared by the Kraft and sulfite-pulping processes.

The cellulosic fibers used in the embodiments described herein also may be pretreated prior to use. This pretreatment may include physical treatment such as subjecting the fibers to steam, caustic, chemical treatment or CTMP (chemi-thermomechanical pulp treatment). For example, the cellulosic fibers may be cross-linked specialty fibers useful for making an acquisition/distribution layer for absorbent products, such as for example those cross-linked with dimethyl dihydroxyethylene urea or alkane polycarboxylic acids. Commercially available cross-linked fiber suitable for use in the embodiments include, for example, XCel™, available from Rayonier Performance Fibers Division (Jesup, Ga.). Commercially available caustic extractive pulp suitable for use in embodiments include, for example, Porosanier-J-HP, available from Rayonier Performance Fibers Division Jesup, Ga.), and Buckeye's HPZ products, available from Buckeye Technologies (Perry, Fla.). The fluff pulp fibers also may be twisted or crimped, as desired.

The cellulosic fibers suitable for use in embodiments described herein may be provided in any of a variety of forms. For example, one feature of the embodiments contemplates using cellulose fibers in sheet, roll, or fluff form. In another embodiment, the cellulose fibers can be in a mat of non-woven material, such as stabilized resin-bonded or thermal-bonded non-woven mat. A mat of cellulose fibers is not necessarily rolled up in a roll form, and typically has a density lower than fibers in the sheet form. In yet another feature of an embodiment, the fluff pulp can be used in the wet or dry state. It is preferred that the fluff pulp be employed in the dry state.

The expression "pulp sheet" as used herein refers to cellulosic fiber sheets formed using a wet-laid process. The sheets typically have a basis weight of about 200 to about 800 gsm and density of about 0.3 g/cc to about 1.0 g/cc. The pulp sheets are subsequently defiberized in a hammermill to convert them into fluff pulp before being used in an absorbent product. Pulp sheets can be differentiated from tissue paper or paper sheets by their basis weights. Typically, tissue paper has a basis weight of from about 5 to about 50 gsm and paper sheets have basis weights of from about 47 to about 103 gsm, both lower than that of pulp sheets.

Impregnation of the cellulosic fibers with an odor-inhibiting formulation may be performed in a number of ways. One embodiment relates to a method of impregnating the cellulosic fibers in sheet or fluff form with the odor-inhibiting formulation by dipping the fibers into an odor-inhibiting formulation, pressing the pulp, and then drying it. Another embodiment contemplates adding the odor-inhibiting formulation to a cellulosic fiber slurry. Other embodiments are directed to applying the odor-inhibiting formulation to the cellulosic fibers by spraying, rolling or printing onto cellulosic fibers. In yet another embodiment, the odor-inhibiting formulation is applied to the cellulosic fibers at any convenient point in the wet-laying manufacturing process of the cellulosic fibers. Another embodiment involves spraying the odor-inhibiting formulation onto defiberized cellulosic fibers during the manufacturing of an absorbent core. Preferably, the odor-inhibiting formulation is sprayed onto partially dried or dried cellulose fibers in sheet form. It should be noted that application of an odor-inhibiting formulation to cellulosic fibers is not limited to application in solution, and can also include application in pure form, or as an emulsion, suspension or dispersion thereof.

After application of the odor-inhibiting formulation to the fiber, the odor-inhibiting agent preferably is present on the fiber in an amount of about 0.001 weight % to 5.0 weight % based on the fiber weight. More preferably, the odor-inhibiting agent is present in an amount of about 0.002 weight % to about 3.0 weight %, even more preferably present in an amount of about 0.003 weight % to about 2.0 weight %, even more preferably present in an amount of about 0.004 weight % to about 1.0 weight %, and most preferably present in an amount of about 0.005 weight % to about 0.5 weight %, based on the fiber weight. In one preferred embodiment, after application of the odor-inhibiting formulation to the fiber, the resultant fiber contains about 0.005 weight % to about 1.0 weight % of the odor-inhibiting formulation, and about 0.001 weight % to about 1.0 weight % of the odor-inhibiting agent.

One benefit of the embodiments described herein is that the resultant cellulosic fibers exhibit excellent anti-microbial properties. Preferably, the odor-inhibiting fiber of the various embodiments continues to exhibit acceptable anti-microbial activity after 8 hours, more preferably the fiber continues to exhibit acceptable anti-microbial activity after 24 hours. As used herein, "acceptable" anti-microbial activity means capability of the fiber to reduce the populations of microorganisms, such as those present in urine, by at least about 0.50 to 1.0 log. Preferably, the odor-inhibiting fiber decreases the microorganisms by at least about 1.0 log, and more preferably by at least about 2.5 log. At this level, a reduction of odor in the fiber is observed. An increased reduction of the population of microorganisms provides further odor-reduction in the fibers.

In one embodiment, the fiber, when dosed with a bacterial suspension of *Proteus mirabilis* in urine, prevents bacteria growth for up to about 24 hours. Preferably, the log bacteria count of the odor-inhibiting fiber is equal to or less than the log bacteria count for untreated cellulosic fiber. Preferably the log bacterial count of the odor-inhibiting fiber decreases by 0.1 log per hour in the first 8 hours of exposure to bacterial suspension of *Proteus mirabilis* in urine. More preferably, the bacteria count decreases by at least 1.0 log in the first 8 hours. Preferably, the bacteria count decreases by at least 0.05 log per hour after the first 8 hours. More preferably, the log bacteria count decreases by 0.075 log per hour after the first 8 hours, up to 24 hours.

In another embodiment, the odor-inhibiting fibers have a reduced odor, when compared to untreated fiber. For example, on a qualitative odor scale with values ranging from 0 to 4 (with 4 being the most odorous), preferably the odor-inhibiting fiber insulted with bacterial suspension of *Proteus mirabilis* in urine exhibits an average value of less than 1 in the first 16 hours. More preferably, the odor value for the odor-inhibiting fiber of the embodiments does not exceed 1 after 48 hours of exposure.

In another embodiment, the odor-inhibiting fibers insulted with bacterial suspension of *Proteus mirabilis* in urine preferably maintain a pH of less than about 8.0 for up to 24 hours. More preferably, the odor-inhibiting fibers insulted with bacterial suspension of *Proteus mirabilis* in urine maintain a pH of less than about 7.0, and most preferably maintain a pH about 5.5 to 6.0, which is similar to that of human skin, over 24 hours. Maintenance of the pH at about the pH of skin reduces the tendency of the wearer to develop skin irritation and rashes. A pH above this level is an indication of increased amounts of ammonia, which is believed to be a contributing factor of diaper rash and other skin irritation. Preferably, the odor-inhibiting fibers insulted with bacterial suspension of *Proteus mirabilis* in urine preferably maintain an ammonia level below 100 ppm for up to about 24 hours. The odor-inhibiting fiber insulted with bacterial suspension of *Proteus mirabilis* in urine, preferably prevents ammonia generation for up to about 24 hours, and more preferably prevents ammonia generation for up to about 36 hours.

The odor-inhibiting fibers made according to the embodiments provide anti-microbial characteristics and odor control properties that are beneficial for various absorbent article applications, such as for personal care, medical uses, and other applications in which bacterial growth may be a problem. Exemplary personal care absorbent articles include without limitation diapers, training pants, swim wear, absorbent underpants, baby wipes, adult incontinence products, feminine hygiene products, and the like. Exemplary medical absorbent articles include, without limitation, garments, under pads, absorbent drapes, bandages, and medical wipes. Absorbent articles made in accordance with the embodiments are useful in reducing the growth of bacteria and other microbes, such as those present in urine and other bodily fluids, thus reducing the discomfort of the wearer and preventing infections.

The fiber of the embodiments is particularly useful in an absorbent core used in absorbent articles intended for personal care applications, such as diapers, feminine hygiene products or adult incontinence products. The phrase "absorbent core" as used herein generally refers to a matrix of cellulosic fibers with superabsorbent material disposed amongst fibers.

The expressions "superabsorbent material" and "superabsorbent polymer" ("SAP") as used herein refer to any polymeric material that is water-insoluble and water swellable, and capable of absorbing large amounts of fluid (e.g., 0.9% solution of NaCl in water, or blood) in relation to their weight. Superabsorbent polymers also can retain significant amounts of liquid under moderate pressure. Examples of such absorbent polymers are hydrolyzed starch-acrylonitrile graft copolymer; a neutralized starch-acrylic acid graft copolymer, a saponified acrylic acid ester-vinyl acetate copolymer, a hydrolyzed acrylonitrile copolymer or acrylamide copolymer, a modified cross-linked polyvinyl, alcohol, a neutralized self-cross-linking polyacrylic acid, a cross-linked polyacrylate salt, carboxylated cellulose, and a neutralized cross-linked isobutylene-maleic anhydride copolymer. An absorbent material of the embodiments can contain any commonly-known or later-developed SAP. The SAP can be in the form of particulate matter, flakes, fibers and the like. Exemplary particulate forms include granules, pulverized particles, spheres, aggregates and agglomerates. Exemplary and preferred SAP's include salts of crosslinked polyacrylic acid such as sodium polyacrylate.

The absorbent core or composite may comprise one or more layers that contain odor-inhibiting fiber. In a preferred embodiment, the absorbent core contains about 20 weight % to about 100 weight % odor-inhibiting fibers, based on the total weight of the absorbent core. More preferably, the absorbent core contains from about 60 weight % to about 100 weight % odor-inhibiting fibers. The absorbent core also preferably contains about 0 weight % to about 80 weight % SAP, and more preferably contains from about 10 weight % to about 80 weight % SAP. The superabsorbent polymer may be distributed throughout the absorbent core within the voids in the fibers. In another embodiment, the superabsorbent polymer may be attached to odor-inhibiting fibers using a binding agent such as, for example, a material capable of attaching the SAP to the fiber via hydrogen bonding, (see, for example, U.S. Pat. No. 5,614,570, the disclosure of which is incorporated herein by reference in its entirety).

The odor-inhibiting fiber of the embodiments can be used alone in the absorbent core or in combination with untreated fibers. Exemplary untreated fibers include conventional cellulose fibers, synthetic fibers, and the like. Any conventional cellulosic fiber may be used, including any of the wood fibers mentioned herein, caustic-treated fibers, rayon, crosslinked fibers, cotton linters, and mixtures and combinations thereof. In one embodiment, the absorbent core contains one or more layers that comprise a mixture of odor-inhibiting fibers and conventional cellulosic fibers. Preferably, the absorbent core also contains SAP. Preferably, the one or more layers contain from about 10 weight % to about 80 weight % of the odor-inhibiting fiber, and more preferably from about 20 weight % to about 60 weight % of the odor-inhibiting fiber, based on the total weight of the layer. Preferably, the fiber mixture contains from about 1 weight % to 99 weight % of the odor-inhibiting fiber, and more preferably contains from about 60 weight % to about 99 weight % of the odor-inhibiting fiber, based on the total weight of the fiber mixture.

In an embodiment in which the absorbent core or composite has upper and lower layers, it is preferable that the lower layer comprises a composite of conventional cellulosic fibers and superabsorbent polymer. In this embodiment, the lower layer has a basis weight of about 40 gsm to about 850 gsm. The upper layer preferably contains odor-inhibiting fiber. More preferably the odor-inhibiting fiber is a cross-linked fiber treated with the odor-inhibiting formulation of the embodiments. Any cross-linked fibers known in the art could be used in the embodiments. Exemplary cross-linked fibers include cellulosic fibers cross-linked with compounds such as formaldehyde or its derivatives, glutaraldehyde, epichlorohydrin, methylolated compounds such as urea or urea derivatives, dialdehydes such as maleic anhydride, non-methylolated urea derivatives, polycarboxylic acids or polymeric polycarboxylic acids such as citric acid, polymaleic acid or other such compounds. For example, suitable cross-linked fibers are described in U.S. Patent Publication No. 20050079361A1, the disclosure of which is incorporated herein by reference in its entirety.

The upper layer preferably has a density of about 0.03 g/cc to about 0.2 g/cc, preferably about 0.05 g/cc to about 0.15 g/cc and most preferably about 0.1 g/cc. Preferably, the upper layer has a basis weight from about 50 gsm to about 400 gsm and most preferably about 300 gsm. Preferably the lower layer has a density and basis weight greater than the upper layer. For example, the lower layer preferably has a density of about 0.1 g/cc to about 0.30 g/cc. Preferably, the lower layer has a basis weight of about 120 gsm to about 850 gsm.

The upper layer and the lower layer of the absorbent core may have the same overall length and/or the same overall width. Alternately, the upper layer may have a length that is longer or shorter than the length of the lower layer. Preferably, the length of the upper layer is 60% to 90% the length of the lower layer. The upper layer may have a width that is wider or narrower than the width of the lower layer. Preferably, the width of the upper layer is 80% the width of the lower layer.

Each layer of the absorbent core may comprise a homogeneous composition, where the odor-inhibiting fiber is uniformly dispersed throughout the layer. Alternately, the odor-inhibiting fiber may be concentrated in one or more areas of an absorbent core layer. In one embodiment, a single layer absorbent core contains a surface-rich layer of the odor-inhibiting fiber. Preferably, the surface-rich layer has a basis weight of about 40 gsm to about 400 gsm. Preferably, the surface-rich layer has an area that is about 30% to about 70% of the total area of the absorbent core.

Although any method of making an absorbent core may be employed, preferably the absorbent core is formed by an air-laying process. Production of an absorbent core material by air-laying means is well known in the art. Typically in an air-laying process, sheets of cellulosic fiber (e.g., the odor-inhibiting fiber) are defiberized using a hammermill to individualize the fibers. The individualized fibers are blended in a predetermined ratio with SAP particles in a blending system and pneumatically conveyed to a series of forming chambers. The blending and distribution of absorbent materials can be controlled separately for each forming chamber. Controlled air circulation and winged agitators in each chamber produce uniform mixture and distribution of fibers and SAP. The SAP can be thoroughly and homogeneously blended throughout the web or contained only in a specific layer by distributing it to a selected forming chamber. Fibers and SAP from each forming chamber are deposited by vacuum onto a forming screen, thus forming an absorbent web. The web then is transferred from the forming screens to a carrier layer or conveyer system, and is subsequently compressed using calenders to achieve a predetermined density. The densified web may then be wound into a roll using conventional winding equipment. In another embodiment, the forming screen can optionally be covered with tissue paper or tissue-like material as a carrier layer to reduce the loss of material. The carrier layer may be removed prior to calendering or may be incorporated into the formed absorbent core material.

It also is contemplated herein that an absorbent core having odor-inhibiting fibers may be obtained by manufacturing an absorbent core, as described above, using conventional fluff pulp fiber, and thereafter applying the odor-inhibiting formulation to the post-manufactured absorbent core. In this embodiment, the application of the odor-inhibiting formulation may be performed, for example, by spraying, rolling, and/or printing the odor-inhibiting formulation onto the web of absorbent core material, or onto individualized absorbent cores that have been prepared from the web of absorbent core material.

In order that the various embodiments may be more fully understood, the invention will be illustrated, but not limited, by the following examples. No specific details contained therein should be understood as a limitation to the embodiments except insofar as may appear in the appended claims.

Test Methods:

Odor-Inhibiting Efficacy Test

The tests were performed by Analytical Services Inc. (ASI) in Atlanta, Ga. Bacteria count was performed using the "total aerobic plate count" test method.

A bacterial suspension of *Proteus mirabilis* was inoculated into a human urine medium containing 2% Trypticase broth. Human urine from a minimum of ten individuals was collected and sterilized a few days before the study. The bacterial suspension was prepared to provide about $10^4$ to $10^8$ colony-forming units in a blank sample when diluting 10 mL of the bacterial suspension with 90 mL of the urine medium. Seventy-five mL of this medium was dispensed into sealable glass jars containing various samples comprised of fluff fiber and superabsorbent polymer. Each sample contained approximately 1.875 grams fluff fiber and 0.625 grams of superabsorbent polymer. The glass jars containing the sample and urine medium were incubated at 35° C. and tested for plate count, pH of the urine medium, ammonia in the headspace of the jar, and qualitative odor assessment at 0, 4, 8, 24, and 48 hours of incubation time. The tests were carried out by first inserting an ammonia detector (Model GV-100, SKC Gulf Coast Inc., Houston, Tex.) tube through a sealable hole in the lid of the jar to measure ammonia in the headspace above the sample; second, transferring 5 mL of the medium through a hole in the lid of the jar for plate count (2 mL) and pH measurement (3 mL). A new pipette was used for each transfer. Third, the lid of the jar was removed for an expert qualitative odor assessment. The jars were resealed and incubated between tests.

EXAMPLES

This example illustrates a representative method for making odor-inhibiting cellulosic fibers in sheeted roll form in accordance with an embodiment.

Four samples of odor-inhibiting formulations containing 10 weight % of various odor-inhibiting agents in different liquid carriers were prepared as follows:

- Formulation A: the odor-inhibiting agent was urease inhibitor phenylphosphorodiamidate (obtained from Alfa Aesar, Ward Hill, Mass.); the liquid carrier was polypropylene glycol.
- Formulation B: the odor-inhibiting agent was biocide 4-chloro-3,5-dimethylphenol (obtained from Aldrich, Milwaukee, Wis.); the liquid carrier was triacetin (obtained from Vitusa Products Inc., Berkeley Hts., N.J.).
- Formulation C: the odor-inhibiting agent was biocide Triclosan (obtained from Essential, Buford, Ga.); the liquid carrier was triacetin (Eastman Chemical Company, Kingsport, Tenn.).
- Formulation D: the odor-inhibiting agent was hydrogen peroxide (obtained from Aldrich, Milwaukee, Wis.); the liquid carrier was a mixture of water and polypropylene glycol mixed in a ratio of 1:2 by weight. Formulation D also contained 5 weight % of peroxy stabilizing agent citric acid.

Each of the odor-inhibiting formulations A-D were applied to sheets of cellulosic fibers taken from rolls of Rayfloc-JLD® (commercially available from Rayonier, Inc., Jesup, Ga.) having basis weight of 640 gsm. The odor-inhibiting formulation was sprayed onto the sheets using a pilot scale K&M spraying system. The odor-inhibiting formulation was applied to the sheets to provide about 0.05 weight % of the odor-inhibiting agent to the fiber, based on fiber weight. Formulation D (in which the odor-inhibiting agent was hydrogen peroxide) was applied to the sheet in an amount sufficient to provide about 0.5 weight % hydrogen peroxide and about 0.25 weight % citric acid to the fiber, based on the fiber weight. The produced sheets were then defiberized by feeding them through a hammermill, then evaluated for anti-microbial and odor-inhibiting activities without any further treatment.

The efficacy of the resultant odor-inhibiting fibers was evaluated according to the test method provided above. Bacteria count, pH, odor, and quantity of ammonia generated were determined. FIGS. 1, 2, 3 and 4 show the results for the sample treated with Formulation C (OCF 200), in comparison to a blank sample (bacterial suspension of *Proteus mirabilis* in urine), a control sample (untreated Rayfloc-JLD), and a commercially-available superabsorbent polymer treated with an anti-bacterial agent (OC SAP).

Referring now to the figures, FIG. 1 shows the bacteria count for each of the four samples. As shown in FIG. 1, the odor-inhibiting fiber samples (OCF 200) prevented bacterial growth better than the other samples. For example, over a 24 hour period, the bacterial count for sample OCF was reduced from 5.7 log to 3.2 log, while the bacterial count for the blank, control, and OC SAP samples had increased from 5.7 log to about 7.5 log, 7.7 log, and 8.1 log respectively. Also, FIG. 1 shows that the OCF 200 sample exhibited continuous reduction in bacteria count up to 24 hours, after which the bacteria growth increased at a very low rate (0.0125 log/hour) up to 48 hours. In contrast, the other samples exhibited bacterial growth almost immediately, continuing generally throughout the 48 hour test period.

Figure 2:
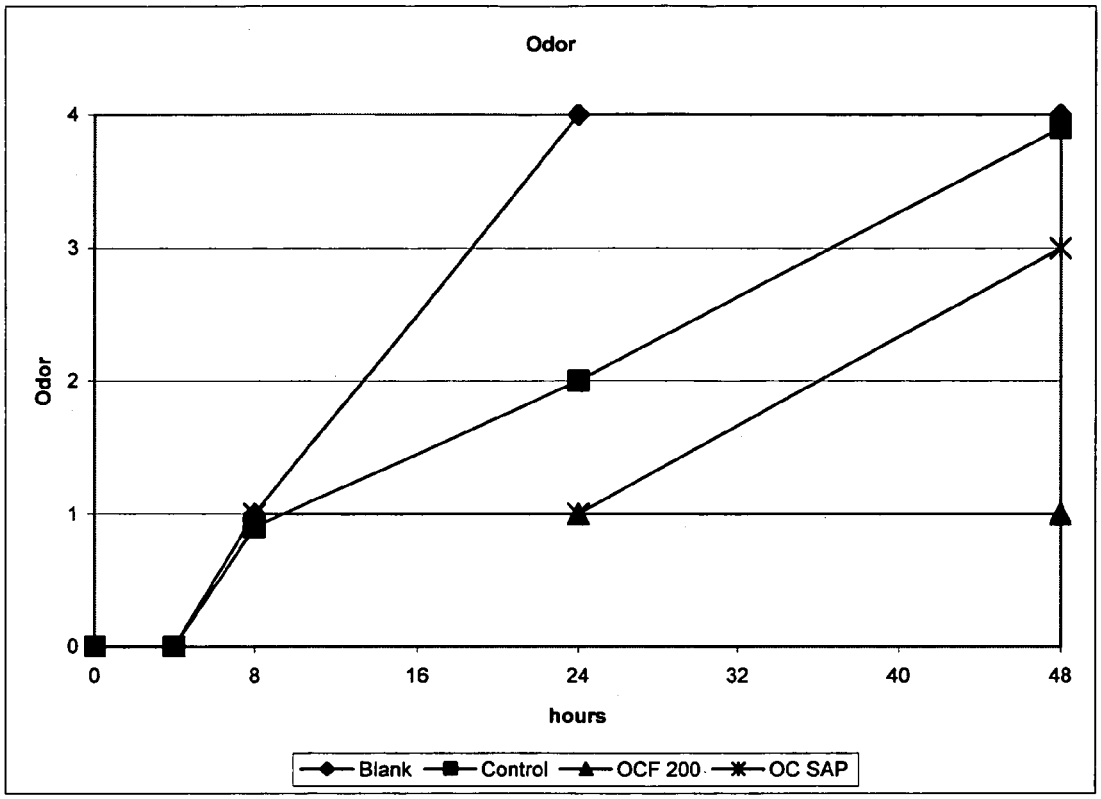
FIG. 2 is a graph showing odor values over a 48-hour test period, for an odor-inhibiting fiber sample made according to the Example, a blank, a control and OC SAP.

FIG. 2 shows the perceived odor level of each of the four samples, using a qualitative odor scale with values ranging from 0 to 4 (with 4 being the most odorous). The data in the figure show that the odor-inhibiting sample OCF 200 maintained a lower odor level over the test period than the blank, control and OC SAP samples. In specific after 8 hours of exposure to urine, the OCF 200 exhibited an odor level of 1, and maintained that level up to 48 hours. In contrast, the perceived odor level of the blank, control, and OC SAP samples continuously increased during the test period. After 48 hours, the blank and control samples approached a perceived level of 4 (the highest odor level), while the OC SAP sample approached a level of 3.

Figure 3:
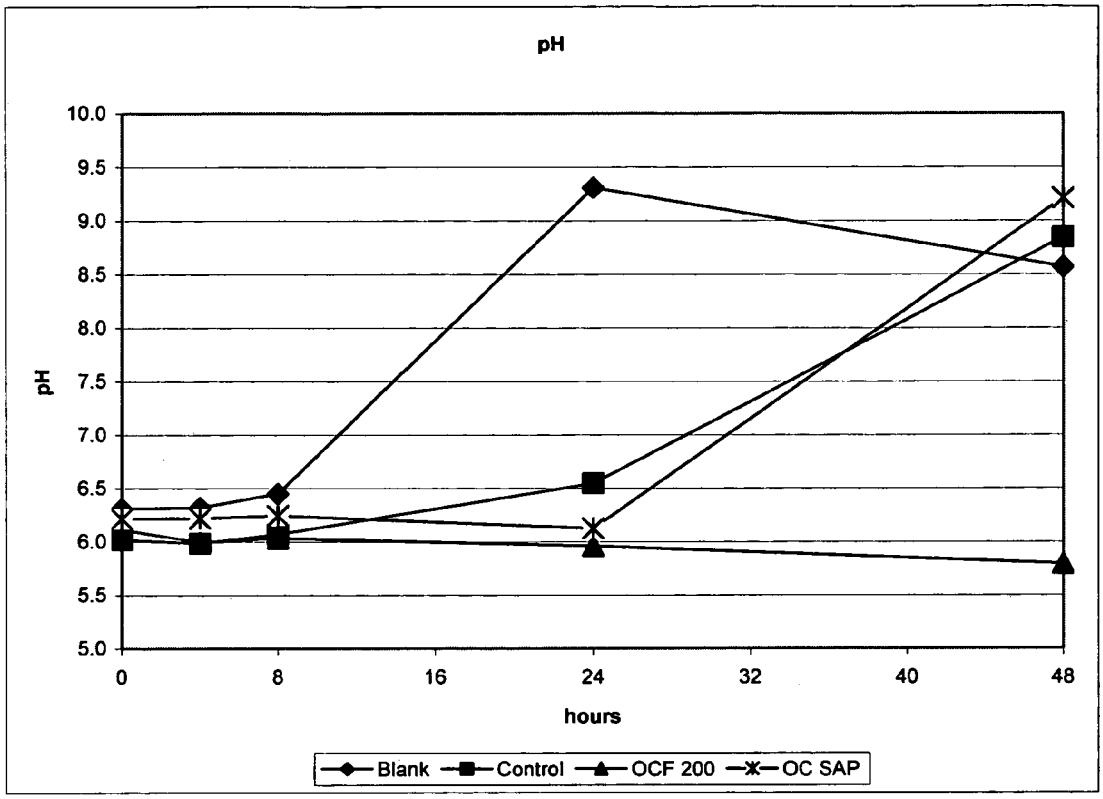
FIG. 3 is a graph showing pH over a 48-hour test period, for an odor-inhibiting fiber sample made according to the Example, a blank, a control and OC SAP.
Figure 4:
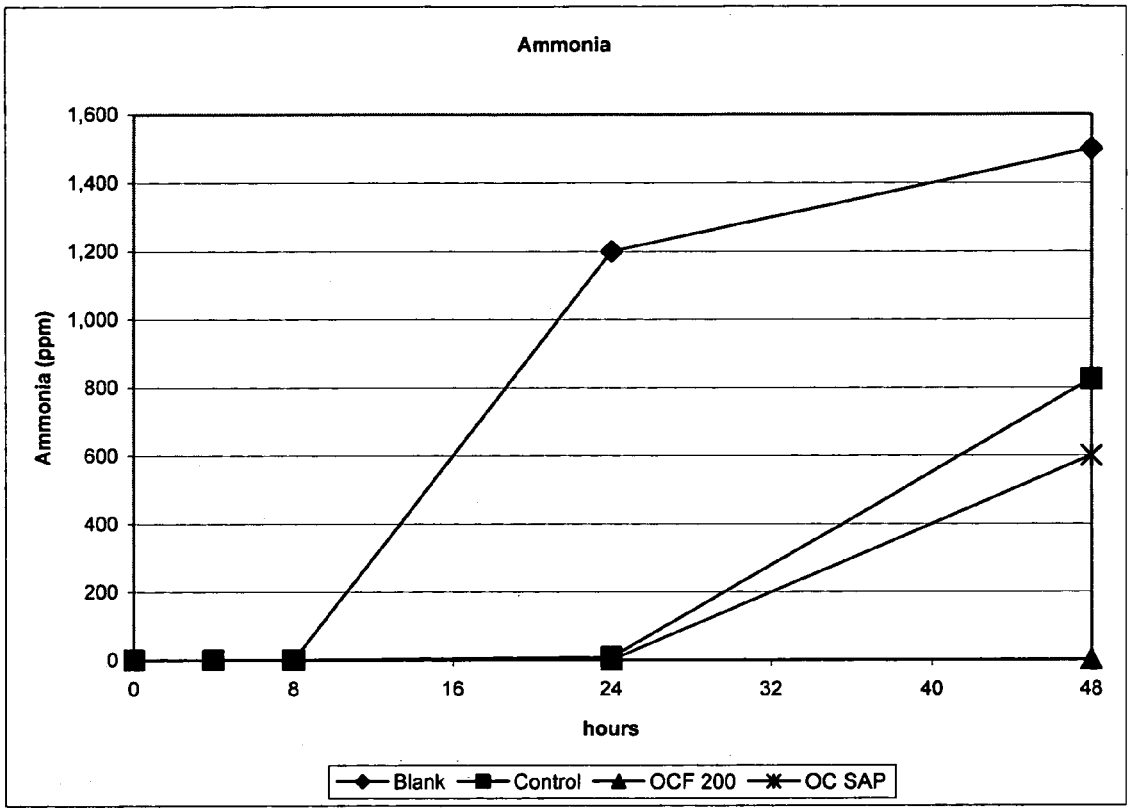
FIG. 4 is a graph showing ammonia levels over a 48-hour test period, for an odor-inhibiting fiber sample made according to the Example, a blank, a control and OC SAP.

FIG. 3 shows the pH level of the odor-inhibiting fiber sample as compared to the blank, control, and OC SAP samples during the test period. The data in the figure show that the pH of the OCF 200 odor-inhibiting sample was maintained at the natural pH of urine (5.5 to 6.5) for more than 48 hours. The pH of the OCF 200 sample dropped from 6.12 to 6.0 after 4 hours (which is consistent with the decrease in bacteria count), and the pH was maintained below 6.0 for the duration of the 48 hour test period. In contrast, the pH of the control sample increased during the first 4 hours, and increased dramatically after 24 hours, approaching a pH of 9 after 48 hours; and the pH of the OC SAP sample started to increase dramatically after about 24 hours, exceeding a pH of 9 after 48 hours. The high pH indicates an increase in the amount of ammonia released. This is confirmed by the measurements of ammonia levels in the samples during the test period, shown in FIG. 4. The data in the figure show that the odor-inhibiting samples released almost no ammonia for the duration of the 48-hour test period. In comparison, the ammonia level of the control sample increased over the duration of the test period, reaching a level of greater than 800 ppm after 48 hours.

While the invention has been described with reference to particularly preferred embodiments and examples, those skilled in the art recognize that various modifications may be made to the invention without departing from the spirit and scope thereof.

What is claimed is:

1. An odor-inhibiting absorbent fiber composition comprising:

a pulp sheet of cellulosic fibers impregnated with a non-fiber-swelling odor-inhibiting formulation comprising a non-water liquid carrier that is liquid at room temperature and has less than 20 weight % water, and an odor-inhibiting agent that is a biocide;

wherein the odor-inhibiting fiber composition comprises from about 0.005 weight % to about 0.5 weight % biocide, and from about 0.025 weight % to about 1.0 weight % non-water liquid carrier, based on the dry weight of the odor-inhibiting fiber composition.

2. The odor-inhibiting fiber of claim 1, wherein the odor-inhibiting agent is a biocide selected from the group consisting of a glutaraldehyde, an analide ($C_6H_5NHCOR$), a biguanide, hexachlorophene, 4-chloro-3,5-dimethylphenol, 5-chloro-2-(2,4-dichlorophenoxy)phenol, trichlorocarbanalide, hexachlorophene, chlorhexidine, benzylquaternium salts, N-(4-chlorophenyl)-N'-(3,4-dichlorophenyl)-urea, 2,4,4'-trichloro-2'-hydroxy diphenyl ether (triclosan), 4-chloro-3,5-dimethyl phenol, 2,2'-methylene-bis-(6-bromo-4-chlorophenol), 3-methyl-4-(1-methylethyl)-phenol, 2-benzyl-4-chlorophenol, 3-(4-chlorophenoxy)-propane-1,2-diol, chlorohexidine, 3,4,4'-trichlorocarbanilide (TTC), 3,4,4'-trichlorobanilide, chitosan or chitin derivatives, diglycerol monocaprate (DMC), zinc salts, dodecane-1,2-diol, salicylic acid-N-alkyl amides where the alkyl groups contain 1 to 22 carbon atoms linear or branched, hexadecyltrimethyl ammonium bromide, and combinations and mixtures thereof.

3. The odor-inhibiting fiber of claim 1, wherein the odor-inhibiting agent is a urease inhibitor selected from the group consisting of N-(n-butyl)thiophosphoric triamide, cyclohexylphosphoric triamide, phenyl phosphorodiamidate, an alkali metal fluoride, an alkali metal bisulfite, an alkali metal borates, boric acid, Yucca schidigera, and combinations and mixtures thereof.

4. The odor-inhibiting fiber of claim 1, wherein the odor-inhibiting agent is the enzyme lysozyme.

5. The odor-inhibiting fiber of claim 1, wherein the odor-inhibiting formulation comprises about 0.1 weight % to about 50 weight % odor-inhibiting agent.

6. The odor-inhibiting fiber of claim 1, wherein the liquid carrier comprises a hydrophobic liquid carrier that is sparingly soluble in water.

7. The odor-inhibiting fiber of claim 6, wherein the hydrophobic liquid carrier is an ether or an ester of polyhydric alcohol, having an alkyl moiety of 3 or more carbon atoms.

8. The odor-inhibiting fiber of claim 6, wherein the hydrophobic liquid carrier is selected from the group consisting of triacetin, diacetin, propylene carbonate, and combinations and mixtures of thereof.

9. The odor-inhibiting fiber of claim 1, wherein the liquid carrier comprises a hydrophilic liquid carrier.

10. The odor-inhibiting fiber of claim 9, wherein the hydrophilic liquid carrier is a monohydric alcohol, a polyhydric alcohol, or an amino alcohol, having an alkyl group with two or more carbon atoms.

11. The odor-inhibiting fiber of claim 9, wherein the hydrophilic liquid carrier is selected from the group consisting of 1,4-cyclohexanedimethanol (1,4-CHDM), pentaerythritol, polyethylene glycol, glycerol, propylene glycol, di-propylene glycol, tri-propylene glycol, polypropylene glycols, diethanolamine, diethanolamine, diglycolamine, and combinations and mixtures thereof.

12. The odor-inhibiting fiber of claim 1, wherein the liquid carrier comprises material able to covalently bond to cellulosic fibers or to both cellulosic fibers and the odor-inhibiting agent.

13. The odor-inhibiting fiber of claim 12, wherein the liquid carrier comprises a material selected from the group consisting of a mono- or poly-functional epoxy, a mono- or poly-functional aldehyde, a ketone, and combinations and mixtures thereof.

14. The odor-inhibiting fiber of claim 11, wherein the liquid carrier comprises 1,4-CHDM and less than 10% water.

15. The odor-inhibiting fiber of claim 13, wherein the liquid carrier comprises a material selected from a group consisting of 1,4-cyclohexanedimethanol diglycidyl ether, glycerol propoxylate triglycidyl ether, 1,4-butanediol diglycidyl ether, polypropyleneglycol diglycidyl ether, glyoxal, glutaraldehyde, glyceraldehyde, and combinations and mixtures thereof.

16. The odor-inhibiting fiber of claim 1, wherein the liquid carrier comprises a mixture of a hydrophobic liquid carrier and a hydrophilic liquid carrier in a ratio ranging from about 1:10 by weight to about 10:1 by weight of the hydrophobic carrier to the hydrophilic carrier.

17. The odor-inhibiting fiber of claim 1, wherein the liquid carrier comprises a mixture of triacetin and 1,4-cyclohexanedimethanol (1,4-CHDM) in a ratio ranging from about 1:10 by weight to 10:1 by weight of triacetin to 1,4-CHDM.

18. The odor-inhibiting fiber of claim 1, wherein the liquid carrier comprises a material selected from the group consisting of 1,4-cyclohexanedimethanol (1,4-CHDM), triacetin, diacetin, propylene carbonate, polyethylene glycol, polypropylene glycol, and combinations and mixtures thereof.

19. The odor-inhibiting fiber of claim 1, wherein the formulation comprises about 0.1 weight % to about 50.0 weight % of the odor-inhibiting agent, and from about 50.0 weight % to about 99.9 weight % of the liquid carrier.

20. The odor-inhibiting fiber of claim 1, wherein the odor-inhibiting formulation further comprises an odor absorbent selected from the group consisting of cyclodextrin, ethylenediamine tetra-acetic acid, chelating agents, zeolites, activated silica, activated carbon granules and combinations and mixtures thereof.

21. The odor-inhibiting fiber of claim 20, wherein the odor-inhibiting formulation comprises about 0.1 weight % to about 20 weight % of an odor absorbent based on the total weight of the odor-inhibiting formulation.

22. The odor-inhibiting fiber of claim 1, wherein the odor-inhibiting agent is hydrophobic and the liquid carrier is hydrophobic.

23. The odor-inhibiting fiber of claim 1, wherein the odor-inhibiting agent is triclosan and the liquid carrier is triacetin.

24. The odor-inhibiting fiber of claim 1, wherein the cellulosic fiber is a conventional cellulose fiber.

25. The odor-inhibiting fiber of claim 24, wherein the conventional cellulose fiber is obtained from a hardwood cellulose pulp, a softwood cellulose pulp, cotton linters, bagasse, kemp, flax, grass, or a combination or mixture thereof.

26. The odor-inhibiting fiber of claim 1, wherein the cellulosic fiber is a cross-linked cellulose fiber.

27. The odor-inhibiting fiber of claim 1, wherein the fiber, when dosed with a bacterial suspension of *Proteus mirabilis* in urine, prevents bacteria growth for up to about 24 hours.

28. The odor-inhibiting fiber of claim 1, wherein the fiber, when dosed with a bacterial suspension of *Proteus mirabilis* in urine, maintains an ammonia level below 100 ppm for up to about 24 hours.

29. The odor-inhibiting fiber of claim 1, wherein the fiber, when dosed with a bacterial suspension of *Proteus mirabilis* in urine, maintains a pH below about 7.0 for up to about 24 hours.

30. The odor-inhibiting fiber of claim 1, wherein the fiber, when dosed with a bacterial suspension of *Proteus mirabilis* in urine, prevents ammonia generation for up to about 24 hours.

31. The odor-inhibiting fiber of claim 1, wherein the fiber, when dosed with a bacterial suspension of *Proteus mirabilis* in urine, prevents ammonia generation for up to about 36 hours.

32. An absorbent article comprising one or more fluff pulp fibers extracted from the odor-inhibiting fiber composition of claim 1.

33. The absorbent article of claim 32, wherein the absorbent article is selected from the group consisting of a diaper, an incontinent device, a feminine hygiene product, a wipe, a bandage, a bed pad, and any combination thereof.

34. The odor inhibiting fiber of claim 1, wherein the odor-inhibiting formulation comprises a triclosan odor-inhibiting agent and a liquid carrier.

35. The odor inhibiting fiber of claim 34, comprising from about 0.005 wt % to about 0.05 wt % triclosan, and from about 0.05 wt % to about 0.5 wt % liquid carrier, based on the dry weight of the odor-inhibiting fiber composition.

36. The odor inhibiting fiber of claim 34, wherein the liquid carrier comprises triacetin, glycerol, polypropylene glycol, propylene glycol, di-propylene glycol, tri-propylene glycol, polyethylene glycol, or combinations or mixtures thereof.

37. The odor inhibiting fiber of claim 36, wherein the liquid carrier comprises polypropylene glycol having a molecular weight of less than about 500.

38. The odor inhibiting fiber of claim 1, wherein the odor-inhibiting formulation comprises a peroxide odor-inhibiting agent and a liquid carrier.

39. The odor inhibiting fiber of claim 38, comprising from about 0.01 wt % to about 1.0 wt % peroxide, and from about from about 0.05 wt % to about 3.0 wt % liquid carrier, based on the dry weight of the odor-inhibiting fiber composition.

40. The odor inhibiting fiber of claim 39, further comprising a peroxide stabilizer, wherein the molar ratio of peroxide to peroxide stabilizer is from about 1:10 to about 10:1.

41. The odor inhibiting fiber of claim 40, wherein the peroxide stabilizer comprises an organic acid with multicarboxyl groups selected from the group consisting of oxalic acid, malonic acid, succinic acid, maleic acid, lactic acid, adipic acid, tartaric acid, citric acid, and combinations and mixtures thereof.

42. The odor-inhibiting fiber of claim 1, wherein the odor-inhibiting agent is a biocide selected from the group consisting of a peroxide, a peracid, and combinations and mixtures thereof.

43. The odor-inhibiting fiber of claim 1, wherein said liquid carrier does not comprise water.

44. The odor-inhibiting fiber of claim 43, wherein the hydrophilic liquid carrier is selected from the group consisting of 1,4-cyclohexanedimethanol (1,4-CHDM), pentaerythritol, polyethylene glycol, glycerol, propylene glycol, di-propylene glycol, tri-propylene glycol, polypropylene glycols, diethanolamine, diethanolamine, diglycolamine, and combinations and mixtures thereof.

45. The odor-inhibiting fiber of claim 42, wherein the biocide is hydrogen peroxide.

46. The odor-inhibiting fiber of claim 45, wherein the odor-inhibiting formulation further comprises a stabilizing agent.

47. The odor-inhibiting fiber of claim 46, wherein the stabilizing agent is a transition metal chelator, a picolinic acid, or an organic acid with multicarboxyl groups selected from the group consisting of oxalic acid, malonic acid, succinic acid, maleic acid, lactic acid, adipic acid, tartaric acid, citric acid, and combinations and mixtures thereof.

48. The odor-inhibiting fiber of claim 46, wherein the stabilizing agent is selected from the group consisting of a phosphate, a sulfate, a silicate salt of sodium, magnesium, potassium, or calcium, and combinations and mixtures thereof.

49. The odor-inhibiting fiber of claim 46, wherein the stabilizing agent is present in a molar ratio of about 1:10 to about 10:1, of stabilizer to peroxide.

50. The odor inhibiting fiber of claim 47, wherein said fiber comprises from about 0.01% to about 1.0% peroxide; and wherein the stabilizing agent comprises an organic acid with multicarboxyl groups selected from the group consisting of oxalic acid, malonic acid, succinic acid, maleic acid, lactic acid, adipic acid, tartaric acid, citric acid, and combinations and mixtures thereof.

51. The odor inhibiting fiber of claim 46, comprising from about 0.01% to about 1.0% hydrogen peroxide, and a lactic acid stabilizing agent.

52. The odor inhibiting fiber of claim 51, wherein the molar ratio of peroxide to peroxide stabilizer is from about 1:10 to about 10:1.

* * * * *